US006386416B1

(12) United States Patent
Dunshee et al.

(10) Patent No.: US 6,386,416 B1
(45) Date of Patent: May 14, 2002

(54) TAPE DISPENSER

(75) Inventors: Wayne K. Dunshee, Maplewood, MN (US); Joy A. Packard, Somerset, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/295,711

(22) Filed: Apr. 21, 1999

Related U.S. Application Data

(63) Continuation-in-part of application No. 09/063,565, filed on Apr. 21, 1998, now abandoned.

(51) Int. Cl.[7] ..... B26F 3/02
(52) U.S. Cl. ..... 225/49; 225/43; 225/47; 225/53
(58) Field of Search ..... 225/19, 23, 39, 225/43, 46, 47, 48, 49, 53, 56, 65, 66, 89, 91

(56) References Cited

U.S. PATENT DOCUMENTS

| | | | | |
|---|---|---|---|---|
| 1,869,729 | A | 8/1932 | Zuckerman | |
| 2,082,546 | A | 6/1937 | Machate et al. | 206/52 |
| D125,085 | S | 2/1941 | Jackson | |
| 2,275,212 | A | 3/1942 | Valentine | 242/70 |
| 2,295,477 | A | 9/1942 | Jackson | 242/55.5 |
| 2,295,679 | A | 9/1942 | Montbach | 242/55.5 |
| D141,220 | S | 5/1945 | Preble, Jr. | D74/1 |
| D164,733 | S | 10/1951 | Pretzfelder, Jr. | D74/1 |
| 2,694,533 | A | 11/1954 | Zucker | 242/55.4 |
| 2,710,152 | A | 6/1955 | Jones | 242/55.5 |
| D175,066 | S | 7/1955 | Emmert | D74/1 |
| 2,776,095 | A | 1/1957 | Emmert | 242/55.5 |
| 2,790,609 | A | 4/1957 | Hawthorne et al. | 242/55.5 |

(List continued on next page.)

FOREIGN PATENT DOCUMENTS

| | | |
|---|---|---|
| DE | 8804005 | 3/1989 |
| DE | 8911613 | 12/1989 |
| GB | 709053 | 5/1954 |
| GB | 757200 | 9/1956 |
| GB | 2 175 276 A | 11/1986 |

OTHER PUBLICATIONS

"3M Surgical Tape Sampler, Standards that never vary", brochure, 3M Health Care, 1993.

"3M Micropore™ Surgical Tape, the dependable choice for a gentle, general dressing paper tape.", 2 page brochure, 3M Health Care, 1995.

Engineering Drawings for the "Micropore #1535 1" Dispenser", 1 page. admitted prior art.

2 copies of photographs of a prior art edge protector for use with Smith & Nephew medical tape rolls, which edge protector does not afford rotation of the roll of tape relative to the edge protector.

*Primary Examiner*—Boyer Ashley
(74) *Attorney, Agent, or Firm*—Doreen S.L. Gwin

(57) ABSTRACT

A tape dispenser comprises a generally palm-sized housing formed of a single piece of material. The housing completely encloses a roll of tape mounted within the housing for rotation relative to the housing. The housing comprises a body enclosing the roll of tape, an opening in the body for dispensing the tape, and a thumb-engageable cover integrally formed with the body. The thumb-engageable cover is pivotable relative to the body to open and close the opening. The cover includes a cutter (e.g., cutting teeth) for cutting pieces of tape from the roll of tape as the cover is moved to its closed position. Alternatively, cutting teeth may be arranged along both the cover and the body of the housing so that a piece of tape may be cut from the roll be pulling the end of the tape against either row of cutting teeth. Methods of making and using the tape dispenser are also disclosed.

21 Claims, 6 Drawing Sheets

U.S. PATENT DOCUMENTS

| | | | | |
|---|---|---|---|---|
| 2,862,676 | A | 12/1958 | Castelli | 242/55.51 |
| D185,284 | S | 5/1959 | Hofmann | D74/1 |
| D185,639 | S | 7/1959 | Hofmann-Igl | D74/1 |
| D186,343 | S | 10/1959 | Gershen | D74/1 |
| D187,765 | S | 4/1960 | Gershen | D74/1 |
| 2,992,582 | A | 7/1961 | Castelli | 83/611 |
| D192,835 | S | 5/1962 | Wax | D74/1 |
| 3,102,671 | A | 9/1963 | Gershen | 225/43 |
| 3,121,021 | A | 2/1964 | Copeland | 117/122 |
| 3,216,634 | A | 11/1965 | Lausa | 225/19 |
| 3,417,937 | A | 12/1968 | Douglas et al. | 242/55.2 |
| 3,762,261 | A | 10/1973 | Ekenberg | 83/649 |
| 3,972,459 | A | 8/1976 | Cooper | 225/47 |
| 4,060,444 | A | 11/1977 | Schweig, Jr. et al. | 156/391 |
| D260,368 | S | 8/1981 | Dunshee et al. | D9/415 |
| 4,630,765 | A | 12/1986 | Samuelson et al. | 225/96 |
| 4,700,835 | A | 10/1987 | Rognsvoog, Jr. | 206/411 |
| D295,424 | S | 4/1988 | Porter | D19/67 |
| D305,249 | S | 12/1989 | Ukisu | D21/59 |
| 4,998,655 | A | 3/1991 | Huang | 225/26 |
| D323,531 | S | 1/1992 | Fortune | D19/69 |
| 5,083,717 | A | 1/1992 | Samuelson et al. | 242/55.53 |
| 5,090,565 | A | 2/1992 | Wang | 206/411 |
| 5,133,980 | A | 7/1992 | Ream et al. | 426/115 |
| 5,154,335 | A | 10/1992 | Bredow et al. | 225/40 |
| 5,156,311 | A | 10/1992 | Spencer, Jr. et al. | 225/41 |
| D338,493 | S | 8/1993 | Mead | D19/69 |
| 5,294,068 | A | 3/1994 | Baro et al. | 242/55.53 |
| 5,496,603 | A | 3/1996 | Riedel et al. | 428/40 |
| D379,474 | S | 5/1997 | Packard | D19/69 |
| 5,631,073 | A | 5/1997 | Riedel et al. | 442/364 |
| D380,777 | S | 7/1997 | Packard | D19/69 |
| 5,679,190 | A | 10/1997 | Riedel et al. | 156/62.2 |
| 5,698,067 | A | 12/1997 | Packard | 156/577 |
| 5,735,400 | A | 4/1998 | Packard | 206/408 |

TAPE DISPENSER

This application is a continuation-in-part of U.S. patent application Ser. No. 09/063,565, filed Apr. 21, 1998, now abandoned.

TECHNICAL FIELD

The invention relates to tape dispensers for dispensing tape, for example, medical tape, and more particularly relates such tape dispensers that include a cutter for cutting off a piece of tape.

BACKGROUND OF THE INVENTION

Tape dispensers have been in widespread use for years. Tape dispensers have been used to dispense selected lengths of materials from a roll of tape, typically tape that includes a pressure sensitive adhesive. Tape dispensers that include serrations for severing tape have been in use, as have tape dispensers that are formed of one piece of material. One piece tape dispensers have been made that include exposed fixed serrations for severing tape. Problems with exposed fixed blades or serrations include some risk that tape will be inadvertently cut, and that clothing, drapes, surgical gowns, etc., will be snagged by the blade or serrations.

U.S. Pat. Nos. 5,735,400 and Des. No. 380,777 disclose a tape dispenser having a folded one piece design having a bridge member extending between two outer periphery portions. This tape dispenser does not include an integral cutting means. The outer layer of tape remains exposed in this design.

U.S. Pat. No. 5,735,400 describes a one-piece protector for a roll of tape having a releasable hub means, a transverse, peripheral bridge portion extending between outer peripheries of first and second walls.

The 3M Micropore ™ tape dispenser is a folded one-piece design having an integral fixed serrated blade with central nested projections to provide ajournal to mount the tape core. The outer layer of tape remains exposed in this design.

U.S. Design Pat. No. 125,085 discloses a tape dispenser having a folded one-piece construction with a fixed serrated edge on the bridge member. U.S. Design Pat. No. 64,733 discloses a tape dispenser frame having a fixed serrated blade and a tape land for the free end of the tape.

U.S. Pat. No. 2,295,679 describes a reusable tape dispenser stamped out from a single flat blank of sheet metal having a uniplaner base from which extend opposed parallel sides and spaced by the base to a width to accommodate the width of the tape core. Each side portion has a centrally located projection to support the tape core. A fixed cutting blade is located on the base.

SUMMARY OF THE INVENTION

This invention provides a tape dispenser formed with a one piece housing with an integral cover/cutter. The cutting means moves between positions in order to server tape into discrete sections, and is integrated into a one piece tape dispenser. The cutting means is positioned on the cover and is pivotably connected to the main body of the housing to substantially completely enclose the roll of tape within the housing. Moreover, the cutting means is shielded within the body of the housing when the cover/cutter is closed. The tape dispenser of the invention is economical, easy to assembly, and convenient to use. The tape dispenser is preferably sized and configured to be held in the palm of one hand and to be used primarily by one hand.

Generally, a tape dispenser of the invention comprises a housing formed of a single piece of material. The housing comprises opposite sides, a hub extending from at least one side, a bridge connecting the opposite sides, and a cutter pivotably connected to the bridge. The hub is adapted to hold a roll of tape for rotation within the housing, and the cutter being adapted to cut the tape.

Preferably, the opposite sides have opposing flanges extending toward one another to substantially enclose the tape within the housing except for an opening, and the cutter is movable to open and close the opening. For example, the opposing flanges may each have a nesting side edge for interlocking with the nesting side edge of the other flange.

Most preferably, at least one of the opposite sides has a concave open area extending from the opening in the direction toward the hub to provide manual access to the tape when the cutter is moved to open the opening, and the cutter includes a convex flange substantially matching the concave open area to cover the concave open area when the cutter closes the opening.

Also, preferably, the cutter includes a cutting blade integrally formed with the cutter. For example, the cutting blade comprises cutting teeth and reinforcement ribs integrally formed with the cutter. The reinforcement ribs are preferably formed on a side of the teeth in the direction facing generally away from the hub. Alternatively, the cutting blade may be a separate part mounted on the cutter.

The housing preferably forms a channel for receiving the blade of the cutter and lands on opposite sides of the channel for releasably retaining the tape in position to cut the tape with the blade. The integral pair of lands provides surfaces upon which the tape can be anchored and subsequently released. Having two land surfaces allows the tape to be cut and remain in position so that the user can remove the desired section of tape for use, and the remaining free end from the tape roll is located in an area for ease of grasping by the user for advancement for subsequent use.

A product card may be provided having an opening for receiving the housing and tabs for mounting the product card on the housing, and the nesting side edges preferably form slots for receiving the tabs on the product card to hold the product card and housing together.

Most preferably, the dispenser is minimally larger than the roll of tape held by the dispenser.

Preferably, the hub comprises two hub portions, one extending from each side of the housing, the hub portions interlocking to form the hub. The two hub portions comprise first and second hub portions. The first hub portion defines an opening for receiving the second hub portion therein, and includes an annular ridge within the opening. The second hub portion includes locking tabs for engaging the annular ridge to lock the first and second hub portions together.

Most preferably, the first hub portion extends from a first side of the housing to a free end of the first hub, and the free end of the first hub includes a concave open area extending in the direction toward the first side of the housing. The concave open area faces generally in the direction of the bridge to facilitate inserting the second hub portion within the first hub portion when the opposite sides of the housing are pivoted toward each other during assembly of the tape dispenser.

The opposite sides, hub and bridge may be considered as constituting the body of the tape dispenser, and the cutter preferably includes a projection beyond the body of the cutter to facilitate engaging the projection with a thumb to move the cutter.

Most preferably, living hinges pivotably connecting the cutter and opposite sides to the bridge.

In a second aspect of the invention, the tape dispenser generally comprises a generally palm-sized housing formed of a single piece of material, with the housing completely enclosing a roll of tape mounted within the housing for rotation relative to the housing. The housing comprises a body enclosing the roll of tape, an opening in the body for dispensing the tape, and a thumb-engageable cover integrally formed with the body and pivotable relative to the body to open and close the opening. The cover includes a cutter for cutting pieces of tape from the roll of tape.

Preferably, the body comprises a bridge having opposite ends, opposite sides, and a hub. The opposite sides have opposing flanges extending toward one another. The opposite sides are connected to the opposite ends of the bridge via living hinges. The opposing flanges each have a nesting side edge interlocking with the nesting side edge of the other flange. The hub extends from at least one of the sides for rotatably supporting the roll of tape within the body.

Most preferably, at least one of the opposite sides has a concave open area extending from the opening in the body in the direction toward the hub to provide manual access to the tape when the cover is moved to open the opening. The cover includes a convex flange substantially matching the concave open area to cover the concave open area when the cover closes the opening.

Also, preferably, the cutter comprises cutting teeth integrally formed with the cover, and reinforcement ribs integrally formed with the cutting teeth and cover on a side of the teeth in the direction facing generally away from the hub. The body forms a channel for receiving the cutting teeth and lands on opposite sides of the channel for releasably retaining the tape in position to cut the tape with the cutting teeth.

The third aspect of the invention is a method of making a tape dispenser from a single piece of material. The method generally comprises the following steps:

(a) molding a tape dispenser blank of single piece construction from polymeric material, the blank including first and second side portions, a cutter, a bridge connected via living hinges to the side portions and cutter, and a hub extending from at least the first side portion;

(b) placing a roll of tape on the hub;

(c) pivoting the side portions relative to the bridge across the living hinges to interlock the hub with the second side portion; and (d) optionally pivoting the cutter relative to the bridge to a closed position if the cutter is not in its closed position upon conclusion of step (c).

Preferably, the first and second side portions each have a flange, and each flange has a nesting side edge for interlocking with the nesting side edge of the other flange. The hub comprises first and second hub portions, one extending from each side portion. The first hub portion defines an opening for receiving the second hub portion therein. The first hub portion includes an annular ridge within the opening, and the second hub portion includes locking tabs. With this preferred construction, the step (c) of pivoting the side portions relative to the bridge across the living hinges to interlock the hub with the second side portion preferably further comprises the following steps: (1) substantially enclosing the tape within tape dispenser except for an opening in the dispenser; (2) interlocking the nesting side edges of the first and second side portions; (3) inserting the second hub portion within the opening of the first hub portion; and (4) engaging the annular ridge with the locking tabs to lock the first and second hub portions together; and the step (d) of pivoting the cutter relative to the bridge to a closed position comprising moving the cutter to close the opening.

Also, preferably, the first hub portion extends from the first side portion to a free end, and the free end includes a concave open area extending in the direction toward the first side portion. The concave open area faces generally in the direction toward the bridge to facilitate. With this construction, the step of inserting the second hub portion within the opening of the first hub portion further comprises inserting the second hub portion at least partly through the concave open area of the first hub portion as the first and second side portions are pivoted toward one another.

If a product card is provided having an opening for receiving the tape dispenser, and tabs for mounting the product card on the tape dispenser, slots are preferably formed in the nesting side edges of the dispenser forming, and the tabs are inserted through, or placed within, the slots to hold the product card and tape dispenser together.

The tape dispenser of the invention thus provides an integral tape-cutting means that is sheathed or shielded between uses within the one-piece dispenser body. This protects the tape-cutting means from the potential to scratch or otherwise damage surfaces (e.g. snag clothing).

Additionally, the one-piece design of the invention substantially encloses the roll of tape within the housing of the tape dispenser when the tape-cutting means/cover is in its closed position, thereby better protecting the tape from contamination.

In yet another preferred aspect of the invention, the tape dispenser generally comprises a housing containing a roll of tape mounted for rotation within the housing. The housing has an opening for removing tape from the roll of tape. A cover is pivotably connected to the housing to open and close the opening. Both the housing and the cover include cutting teeth or a blade such that tape can be pulled against either the cutting teeth or a blade of the cover or the cutting teeth or a blade of the housing to cut a piece of tape pulled from the roll of tape.

These and other features and advantages of the invention will be pointed out hereinafter.

BRIEF DESCRIPTION OF THE DRAWINGS

The invention will be further described with reference to the drawing wherein corresponding reference characters indicate corresponding parts throughout the several views of the drawings, and wherein.

DETAILED DESCRIPTION OF PREFERRED EMBODIMENTS

Figure 1:
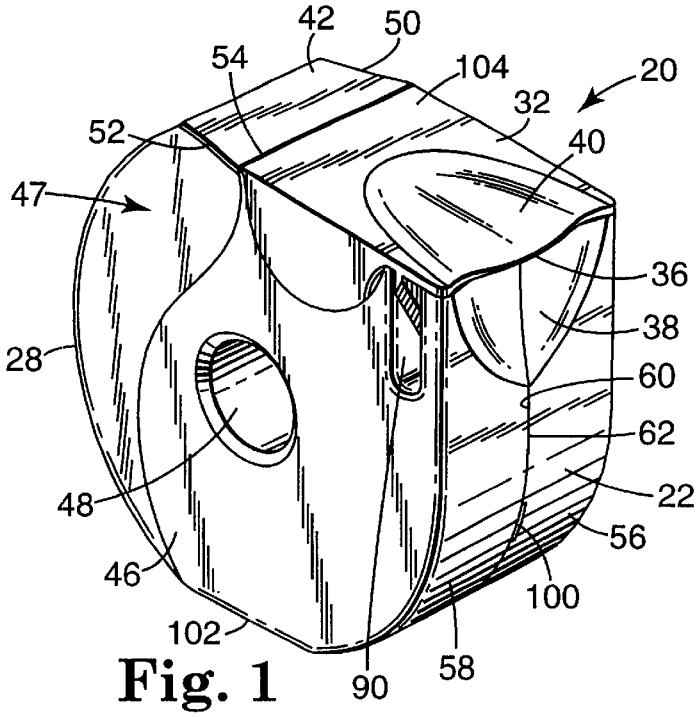
FIG. 1 is a perspective view of a tape dispenser according to this invention with its cover/cutter closed.
Figure 2:
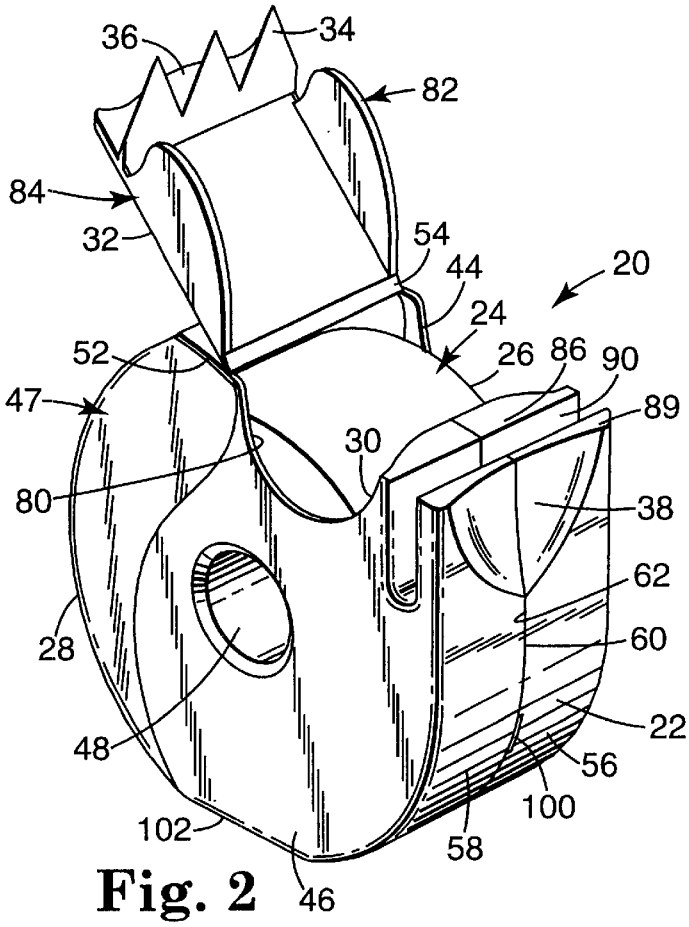
FIG. 2 is a perspective view similar to FIG. 1 with the cover/cutter moved to its open position.
Figure 3:
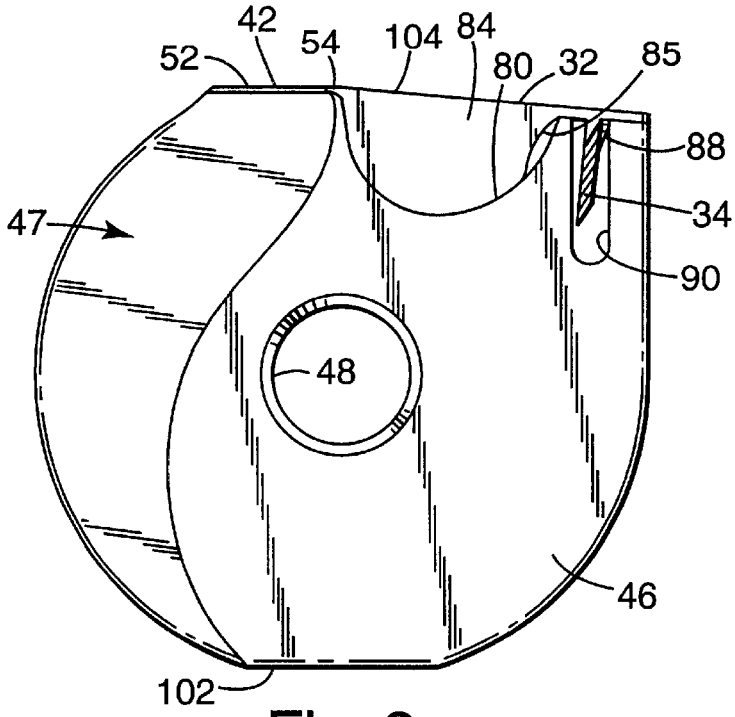
FIG. 3 is right side view of the tape dispenser of FIGS. 1 and 2.
Figure 4:
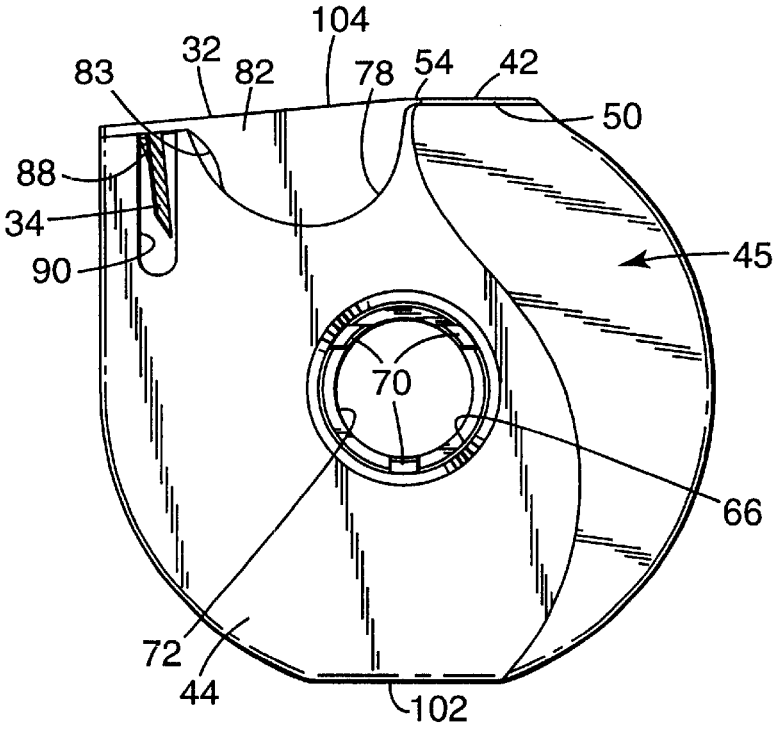
FIG. 4 is a left side view of the tape dispenser of FIGS. 1–3.
Figure 5:
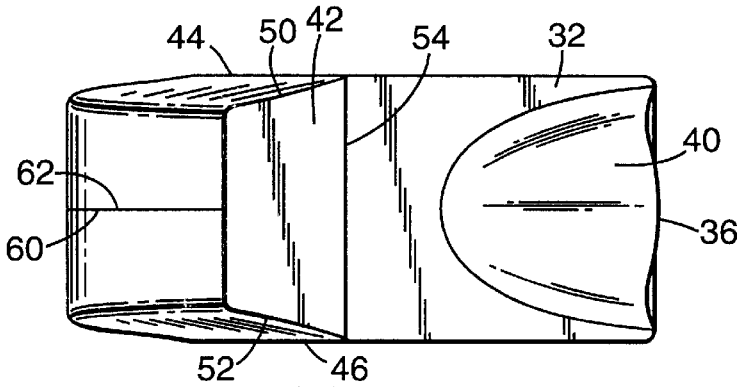
FIG. 5 is a top plan view of the tape dispenser of FIGS. 1–4.
Figure 6:
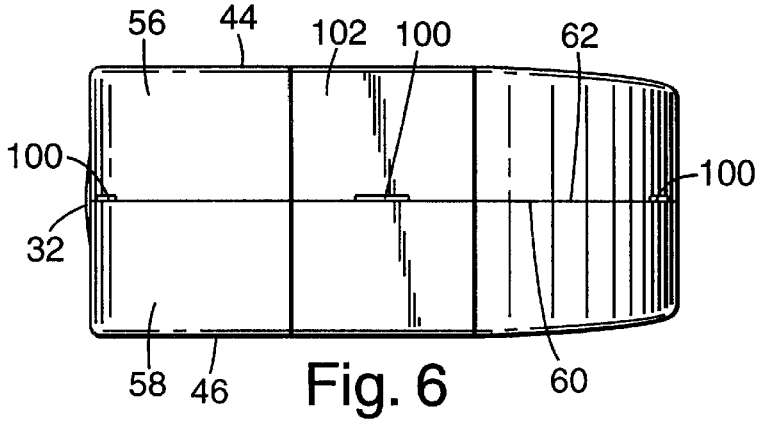
FIG. 6 is a bottom plan view of the tape dispenser of FIGS. 1–5.
Figure 7:
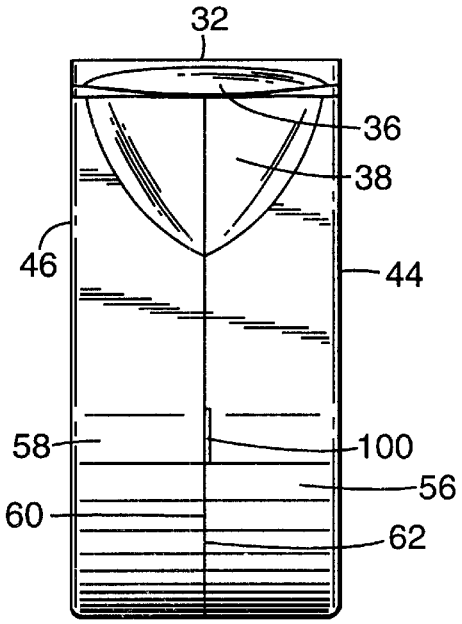
FIG. 7 is a front elevational view of the tape dispenser of FIGS. 1–6.
Figure 8:
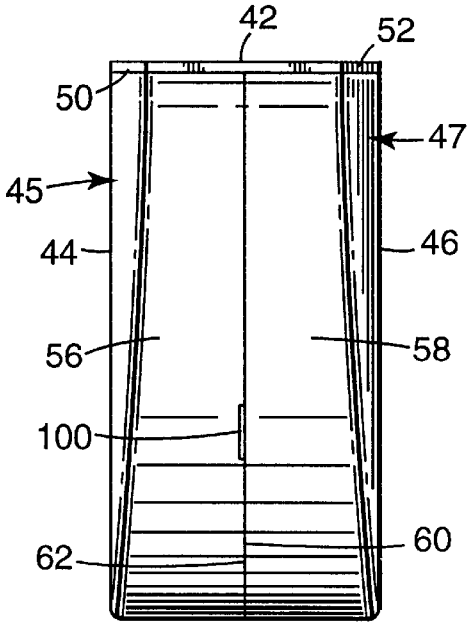
FIG. 8 is a rear elevational view of the tape dispenser of FIGS. 1–7.

Now referring to the drawings, and in particular FIGS. 1–9, the tape dispenser of this invention is designated in its entirety by the reference numeral 20. The tape dispenser 20 generally comprises a housing 22 that is formed of a single piece of material.

As used herein, the terms, "single part", "single piece", "integral" and "one piece construction" mean formed in one continuous piece, for example, by injection molding, vacuum forming, pressure thermoforming, casting, etc., as opposed to formed by connecting separate pieces, for example, mechanically, with adhesive or by welding. The term "single" is intended to exclude the plural, e.g., a "single" part means only one part and not one or more parts.

The tape dispenser 20 is preferably constructed from inexpensive plastic material selected from the group consisting of polystyrene, polypropylene, polyethylene, polycarbonate and acetal resin (such as sold under the tradename "CELCON" by Celanese Chemical Company, or "DELRIN" by E.I. DuPont de Nemours & Company, Wilmington, Del.). For example, the housing blank 21 (FIG. 9) of the tape dispenser 20 may be injection molded of polypropylene material.

Also, as used herein, "tape" means any tape, either with or without an adhesive coating, but preferably it means an tape with a pressure sensing adhesive, such as the medical tapes available under the trade designation "MICROPORE" or "MICROPORE II" from Minnesota Mining and Manufacturing Company, St. Paul, Minnesota. One such tape is disclosed in U.S. Pat. No. 3,121,021 (Copeland), which is incorporated herein by reference. See, also, U.S. Pat. Nos. 5,496,603; 5,631,073 and 5,679,190, which are also incorporated herein by reference.

Figure 10:
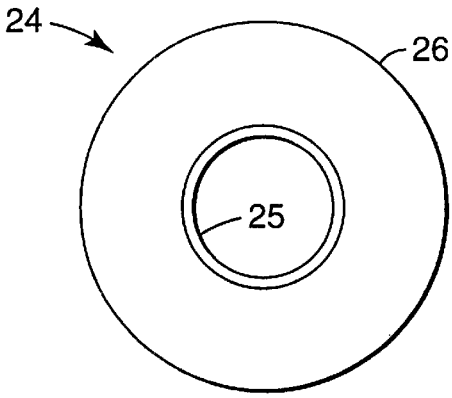
FIG. 10 is a side view of a roll of tape of the type dispensed from the tape dispenser of FIGS. 1–9.

As illustrated in FIG. 10, the roll 24 of tape 26 typically comprises a core 25 (e.g., a cardboard core) around which a pressure sensitive adhesive tape 26 is wound. The pressure sensitive adhesive is on at least one major surface of the tape backing. A low adhesive backsize may be provided on the opposite major surface of the tape 26, or a release liner (not shown) may be provided over the pressure sensitive adhesive. The tape backing may be of any construction: for example, paper, nonwoven (e.g., carded, meltblown or spunbond), plastic or cloth.

The tape dispenser 20 is preferably sized and configured to be held in the palm of the user's hand. As used herein, "palm-sized" means sized to be held in the palm of a human hand. The housing 22 is preferably generally palm-sized.

Most preferably, the tape dispenser 20 is minimally larger than the roll 24 of tape 26 held by the tape dispenser 20. For example, if the width of the roll 24 of tape 26 is about one inch (25.4 mm), the width of the tape dispenser 20 (the width defined by the outer surfaces of the sides 44 and 46) could be about 1-¼ inch (31.8 mm). This is a ratio of about 5:4 between the width of the tape dispenser 20 and the width of the roll 24 of tape 26. If the width of the roll 24 of tape 26 is about ½ inch (12.7 mm), the width of the tape dispenser 20 (the width defined by the outer surfaces of the sides 44 and 46) could be about ¾ inch (19 mm). This is a ratio of about 3:2 between the width of the tape dispenser 20 and the width of the roll 24 of tape 26. The outer periphery of the tape dispenser 20 would similarly be minimally larger than the outer diameter of the full roll 24 of tape 26.

The housing 22 preferably substantially completely encloses the roll 24 of tape 26, which is mounted within the housing 22 for rotation relative to the housing 22. The housing 22 includes a body 28, which encloses the roll 24 of tape 26 therein, 25 except for a tape-dispensing opening 30 in the body 28 through which the tape 26 is dispensed.

A thumb-engageable cover/cutter 32 is integrally formed with the body 28, and is pivotable relative to the body 28 to open and close the tape-dispensing opening 30. The cover/cutter 32 includes a cutter or cutting blade or teeth 34 for cutting pieces of tape 26 from the roll 24 of tape 26. The blade or teeth 34, however, are preferably integrally formed with the cover/cutter 32. In an alternative design (not shown), however, the blade or teeth may be a separate part from the cover/cutter that is mounted on the cover/cutter. Most preferably, three-to-five integral triangularly-shaped teeth 34 are provided.

"Thumb-engageable" means that a portion of the cover/cutter 32 can be engaged by the thumb of the user when the body 28 is held in the palm of the user's hand to open or close the cover/cutter 32. Most preferably, the cover/cutter 32 includes a thumb-engageable projection 36 projecting beyond the body 28 to facilitate engaging the projection 36 to move the cover/cutter 32 away from its closed position covering the tape-dispensing opening 30.

The projection 36 constitutes a preferred means for engaging the cover/cutter 32 with a digit, such as the thumb, to move the cover/cutter 32 between its closed and open positions. Alternative thumb-engageable means include providing a thumb-engageable surface at the free end of the cover/cutter that can be pressed by the thumb or other finger to move the cover/cutter, and/or providing a texture of the free end of the cover/cutter.

Also, preferably, the body 28 includes a shallow depression 38 adjacent the projection 36 to help bring a digit, such as the thumb, into engagement with the projection 36. The cover/cutter 32 may be provided with a similar depression 40 where a digit, such as the thumb, engages the cover/cutter 32 to move the cover/cutter 32 to its closed position to cut or sever a piece of tape from the roll 24 of tape 26. The depressions 38 and 40 may be provided with a gently-rounded concave configuration to help suggest to the user that a thumb or other digit pushes against depression 40 or moves along depression 38.

The housing 22 generally comprises the body 28 and the cover/cutter 32. The body 28 generally comprises a bridge 42, opposite sides 44 and 46, and a hub 48 for rotatably supporting the roll 24 of tape 26 within the housing 22. The opposite sides 44 and 46 are connected to the opposite ends of the bridge 42 via living hinges 50 and 52, and the cover/cutter 32 is connected along a side of the bridge 42 extending between living hinges 50 and 52 by a living hinge 54.

As used herein, the term "living hinge" means a hinge integrally formed with the opposite sides 44 and 46, bridge 42 and/or cover/cutter 32 of the same material. The "living hinges" are part of the blank 21 that is folded to form the housing 22. Typically the material along the living hinge is thin relative to the adjacent areas to facilitate flexing or bending of the opposite sides 44 and 46 relative to the bridge 42 and the cover/cutter 32 relative to the bridge 42. The living hinges constitute one preferred means of a hinge means or means for pivotably connecting the opposite sides 44 and 46 to the bridge or the cover/cutter 32 to the bridge 42.

In the assembled tape dispenser 20, opposing flanges 56 and 58 on the opposite sides 44 and 46 extend toward one another, and the opposing flanges 56 and 58 each have a nesting side edge 60 or 62 interlocking with the nesting side edge 62 or 60 of the other flange 56 or 58. As used herein, the term "assembled" means the roll 24 of tape 26 is place on the one piece blank 21 (FIG. 9), and the blank 21 is folded into its configuration for use. In this context, "assembled" does not require assembly of separate components to form the housing 22 since the housing 22 is formed by a one piece blank 21.

The body 28 also preferably contains tapered portions 45 and 47 along the opposite sides 44 and 46. These tapered areas 45 and 47 are preferably generally adjacent the rear of the tape dispenser 20, and they gradually reduce the width of the body 28 of the housing 22, for example, from 1-¼ inches (31.8 mm) along the main part of the body 28 to about 1 inch (25.4 mm) immediately adjacent the rear of the tape dispenser 20. This amounts to about a 4:5 reduction in thickness adjacent the rear end. These tapered portions 45 and 47 also help to fit the tape dispenser 20 within the palm of the user's hand.

Figure 9:
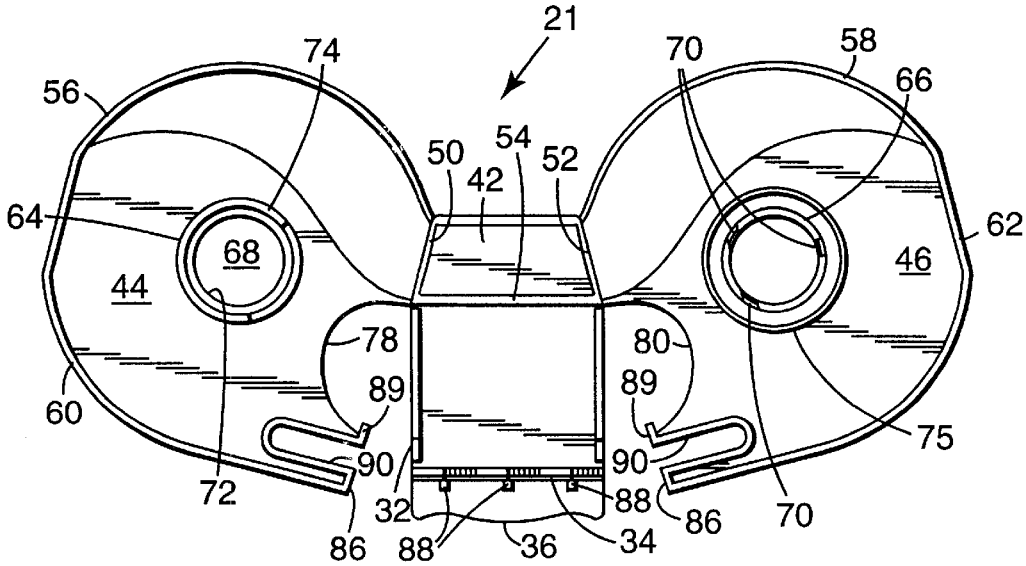
FIG. 9 is a view of a single piece blank that is folded to form the housing of the tape dispenser of FIGS. 1–8.
Figure 11:
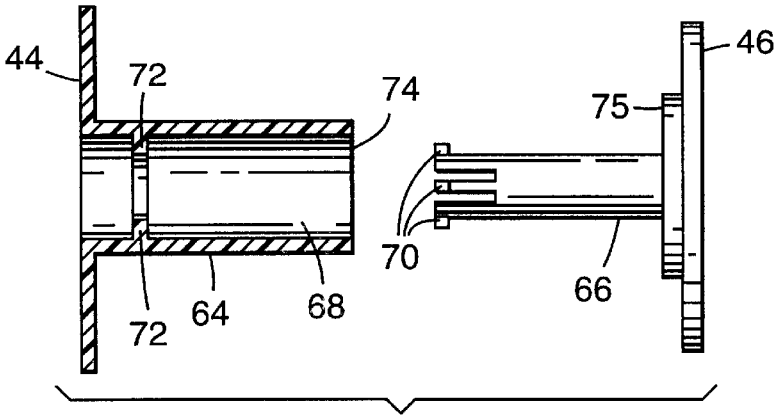
FIG. 11 is an exploded, partly cross-sectional view of the hub portions of the tape dispenser of FIGS. 1–9.

The hub 48 extends from at least one, but preferably both, of the sides 44 and 46 of the housing 22, and rotatably supports the roll 24 of tape 26 within the body 28 of the housing 22. Preferably, as illustrated in FIGS. 9 and 11, the hub 48 comprises first and second hub portions 64 and 66 extending from the first and second sides 44 and 46, respectively, of the body 28. The first hub portion 64 defines an opening 68 for receiving the second hub portion 66 therein.

A plurality (e.g., three) of locking tabs 70 on the second hub portion 66 engage an annular ridge 72 within the opening 68 in the first hub portion 64 to lock the first and second hub portions 64 and 66 together. The locking tabs 70 are formed with a bias toward their locked position but can be moved against this bias to form a snap-lock with the annular ridge 72.

Figure 12:
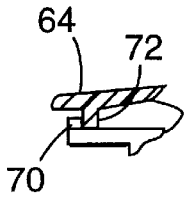
FIG. 12 is an enlarged view of a portion of FIG. 11 illustrating details of a locking means for locking the hub portions of FIG. 11 together.

As illustrated in FIGS. 11 and 12, the locking tabs 70 each include a locking ledge or catch that engages the annular ridge 72, and the ledge or catch is defined by a surface that is generally perpendicular to the central axis of the opening 68 and the first and second hub portions 64 and 66. The ledge or catch extends in the direction generally radially outwardly relative to the central axis of the second hub portion 66.

As used herein, "snap-fit" means that the locking tabs 70 move or "click" to their locked position when the second hub portion 66 is inserted into the first hub portion 64 during assembly of the tape dispenser 20 so that the ledge or catches of the locking tabs 70 just clear the annular ridge 72.

The locking tabs 70 and annular ridge 72 constitute one preferred embodiment of a locking means for locking the first and second hub portions 64 and 66 together, and of a locking means for locking the first and second sides 44 and 46 of the body 28 in their assembled position.

Alternative locking means include any suitable means for locking the hub portions 64 and 66 together or holding the first and second sides 44 and 46 in their assembled position. For example, the locking means may comprise locking a single hub portion extending from the first side directly to the major portion of the second side.

A second example of alternative mechanical locking means could be provided, for example, by an interference or reverse taper/interference fit between a socket portion and projecting portion as disclosed in U.S. Pat. No. 5,735,400, which is incorporated herein by reference.

Another alternative mechanical locking means is to provide a generally C-shaped or crescent-shaped ledge (not shown) within the opening of the first hub portion rather than the annular ledge. The C-shaped or crescent-shaped ledge would preferably be oriented to that its opening faces generally toward the bridge. Yet another example of an alternative locking means would be to provide a plurality of separate ledges in the opening of the first hub portion corresponding to, and in alignment with, the locking tabs of the second hub portion.

While mechanical locking means is preferred, the first and second hub portions could be adhesively interconnected or welded together.

The hub 48 constitutes a preferred embodiment of a mounting means for mounting the roll 24 of tape 26 within the body 28 of the housing 22 for rotation relative to the body 28 of the housing 22. The core 25 of the roll 24 of tape 26 is free to rotate with respect to the hub 48, which is fixed relative to the sides 44 and 46 of the body 28. Alternative mounting means include alternative hub designs or any feature that holds the roll 24 of tape 26 so that the roll 24 can be rotated.

Figure 13:
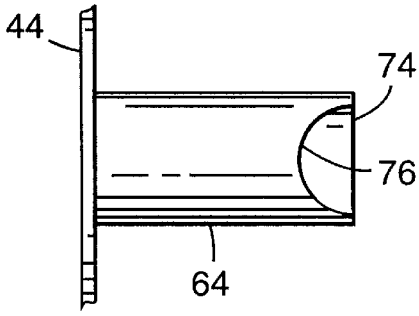
FIG. 13 is a side view of one of the hub portions illustrated in FIGS. 11 and 12 illustrating a concave open area that facilitates assembly of the hub.

Most preferably, the first hub portion 64 extends from a first side 44 of the housing 22 to a free end 74 of the first hub portion 64, and the free end 74 of the first hub 64 includes a concave open area 76 (FIG. 13) extending in the direction toward the first side 44 of the housing 22. The concave open area 76 faces generally in the direction toward the bridge 42 to facilitate inserting the second hub portion 66 within the first hub portion 64 when the opposite sides 44 and 46 of the housing 22 are pivoted toward each other during assembly of the tape dispenser 20. The concave open area 76 compensates for the arc that the first and second hub portions 64 and 66 traverse as the opposite sides 44 and 46 of the housing 22 are pivoted toward each other.

An annular ridge 75 (FIGS. 9 and 11) may also be provided on the inside major surface of the second side 46 of the housing 22. The inside diameter of the annular ridge 75 preferably closely receives the free end 74 of the first hub portion 64 to stabilize the free end 74 of the first hub portion 64 relative to the second side 46 of the housing 22. In this regard, it may be noted that the outer diameter of the second hub portion 66 preferably is significantly smaller than the diameter of the opening 68 within the first hub portion 64 to facilitate insertion of the second hub portion 66 within the opening 68 of the first hub portion 64. For example, the outer diameter of the second hub portion 66 may be about ¾ inch (19 mm), and the diameter of the opening 68 in the first hub portion 64 may be about 11/16 inch (17.1 mm). As used in this context, "significantly smaller" merely means enough smaller that there is not full engagement or an interference or pressure fit between the outer diameter of the second hub portion 66 and the diameter of the opening 68 within the first hub portion 64.

The opening 68 could alternatively be closed off along the outer major surface of the first side 44 without detracting from its function. Such an opening might be considered to be a blind opening, since it would only be open at the free end of the first hub portion. Similarly, the outer major surface of the second side 46 could close off an opening through the second hub portion 66. The opening in the second hub portion 66 conserves material that would be unnecessary for the function of the second hub portion 66.

Preferably, at least one of the opposite sides 44 and 46 of the body 28 but preferably both, has/have a concave open area 78, 80 extending from the tape-dispensing opening 30 in the body 28 in the direction generally toward the hub 48. These access openings 78, 80 constitute extensions of the tape-dispensing opening 30 provide manual access to the tape 26 when the cover/cutter 32 is moved to open the tape-dispensing opening 30. The access openings 78, 80 are shown as having a generally arcuate configuration but could have any of a variety of different configurations.

Convex flanges 82 and 84 are preferably provided on the cover/cutter 32. The convex flanges 82, 84 preferably substantially match the concave open areas/access openings 78, 80 to cover the concave open area/access openings 78, 80 when the cover/cutter 32 closes the tape-dispensing opening 30. The convex flanges 82 and 84 preferably extend generally perpendicularly with respect to the main part of the cover/cutter 32, and preferably closely line up with the outer surfaces of the first and second opposite sides 44 and 46 of the housing 22. As is the case with the access openings 78, 80, the convex flanges 82, 84 are shown as having a generally arcuate configuration but could have any of a variety of different configurations.

If a radius is defined from the living hinge 54 to the inside edge of a tape-retaining ledge, land or surface 86 immediately adjacent the tape-dispensing opening 30, the outer part of the convex flanges 82, 84 and the corresponding outer part of the concave open areas 78, 80 preferably come no closer to the living hinge than this radius. This is to avoid interference between the outer parts of the convex flanges 82, 84 and the outer parts of the concave open areas 78, 80 as the cover/cutter 32 is pivoted between its open and closed positions. In addition, the edge of the convex flanges 82, 84 may be provided with indented or concave portions 83 and 85 along their outer parts ("outer" in this case meaning farther from the living hinge 54).

Reinforcement ribs 88 are preferably integrally formed with blade or teeth 34 of the cover/cutter 32. The reinforcement ribs 88 are formed on a side of the teeth 34 in the direction facing generally away from the hub 48 and generally away from the living hinge 54 connecting the cover/cutter 32 to the body 28. Most preferably, the reinforcement ribs 88 extend generally along a longitudinal direction of the teeth 34 from the main part of the cover/cutter 32 toward the free end of the teeth 34.

Preferably, a channel 90 is formed in the body 28 of housing 22 for receiving the blade or teeth 34 of the cover/cutter 32. The channel 90 extends substantially across the width of the body 28 in a direction generally parallel with the living hinge 54 connecting the cover/cutter 32 to the bridge 42. The channel 90 is sufficiently deep to completely receive the tape-cutting means 34 of the cover/cutter 32 to shield the tape-cutting means 34 when the cover/cutter 32 is in its closed position. The channel 90 may be formed by generally parallel side walls and a generally arcuate bottom wall. The ends of the channel 90 may be open or closed but are shown in the preferred embodiment as being open. The channel 90 is sufficiently wide to receive the tape-cutting means as it traverses an arc to its closed position. For example, the channel 90 may have a width of about 3/16 inch (4.8 mm), a depth of about 5/8 inch (15.5 mm), and a length equal to the width of the body 28 of the housing 22.

Inner and outer lands 86 and 89 are on opposite sides of the channel 90 for releasably retaining the tape 26 in position to cut the tape 26 with the tape-cutting means 34. The adhesive side of the tape 26 engages the lands 86 and 89 and holds the tape 26 in position while the tape-cutting means 34 severs a piece of tape from the roll 24. The outer land 89 has a surface area sufficient to hold the severed piece of tape until it is manually removed from the tape dispenser 20. The inner and outer lands 86 and 89 are preferably generally flat and substantially co-planar with each other and the living hinge 54 connecting the cover/cutter 32 with the bridge 42. In this context, "substantially co-planar" would at least include the living hinge 54 being out of the plane by no more than the thickness of any of the bridge 42, living hinge 54 and/or cover/cutter 32.

Also, preferably, the inner land 86 has a curved inner edge bulging generally toward to living hinge 54 to increase the surface area available for retaining the tape 26 with less interference to grasping the tape than would a straight edge defining a similar top surface of the inner land. This shape also facilitates grasping the tape 26 if that tape 26 falls back to the roll because it allows for greater open area adjacent the sides of the opening than would a straight edge defining a similar top surface of the inner land.

Most preferably, the channel 90 extends from the inner and outer lands 86 and 89 in a direction generally perpendicular to the plane of the inner and outer lands 86 and 89. The channel 90 also preferably extends in a direction tangent to the arc the tape-cutting means 34 travels at its intersection with the plane defined by the inner and outer lands 86 and 89.

The teeth 34 preferably extend at an angle to the cover/cutter 32 such that the teeth 34 are generally perpendicular to the tape 26 when the teeth 34 first engage the tape 26. This angle is such that the teeth 34 adjacent their free ends extend in a direction tangent to a circle having as a central axis the living hinge 54. Among other things, this arrangement cuts the tape 26 so that the end of the tape 26 extends sufficiently past the inner tape-retaining ledge, land or surface 86 to facilitate grasping the end of the tape 26 to advance it into position to cut the next piece. This is accomplished by having cutting the tape 26 closer to the outer tape-retaining ledge, land or surface 89 without jamming the teeth 34 against either side of the channel 90 than could be accomplished with teeth 34 extending perpendicularly to the cover/cutter 32.

Alternatively, the blade or teeth 34 adjacent their base may extend generally in a direction tangent to a radius formed between a central axis formed by the living hinge 54 and an arc defined by the motion of the blade or teeth 34 as the cover/cutter 32 is pivoted relative to the living hinge 54. For example, if the cover/cutter 32 is flat extending from between the living hinge 54 and the base of the blade or teeth 34, the teeth could alternatively extend perpendicular to cover/cutter 32.

Figure 14:
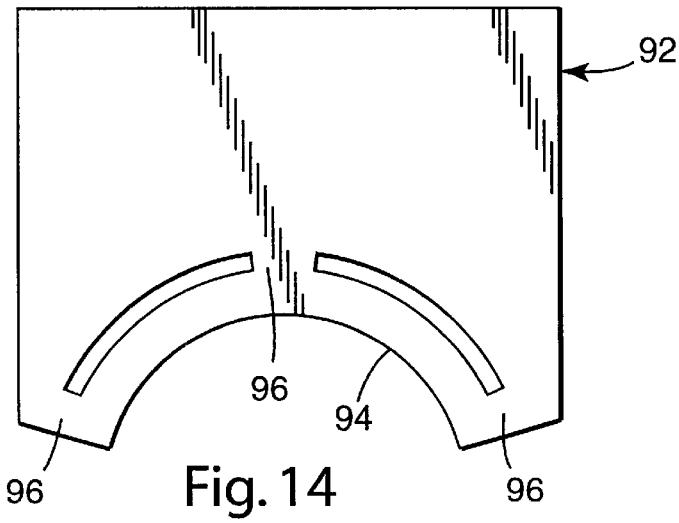
FIG. 14 is a front view of a product card that can be used with the tape dispenser of FIGS. 1–9 and 11–13.

In many uses it may be desirable to include a product card, such as the product card 92 shown in FIG. 14, with the tape dispenser 20. The product card 92 comprises an opening 94 for receiving the body 28 of the housing 22, and a plurality of tabs 96 for mounting the product card 92 on the housing 22. Such product cards 92 are typically formed of cardboard, and are printed with information about the product, such as the name of the manufacture, trademark, instructions, bar code, etc.

In order to retain the product card 92 on the tape dispenser 20, slots 100 may be provided in at least one of the nesting side edges 60 or 62 to receive the tabs 96 on the product card 92. The slots 100 and tabs 96 may be located to hold the tape dispenser 20 in a preferred configuration for display. For example, the tape dispenser 20 may be hold so that the cover/cutter 32 generally extend along the bottom of the combination of the tape dispenser 20 and product card 92. In addition, the slots 100 and tabs 96 can be positioned to ensure that the product card 92 can only be held in its desired orientation. For example, the slots 100 can be positioned relative to the flat 102 along the bottom of the tape dispenser 20 to hold the tape dispenser 20 upside down.

The flat 102 along the bottom of the tape dispenser 20 is generally parallel and opposite the flat 104 formed by the bridge 42 and cover/cutter 32 along the top of the tape dispenser 20. The tape dispenser 20 may be set on its bottom flat 102 to position the cover/cutter 32 along the top. Most preferably, the closed cover/cutter 32 is generally co-planar with the bridge 42 to provide a cleaner line along the top of the tape dispenser 20. Alternatively, the bridge 42 could be offset from the plane of the cover/cutter 32 in its closed position, for example, by orienting the bridge 42 along a tangent with the end of the curve formed by the opposing flanges 56 and 58.

Alternatively, the living hinge between the cover/cutter and the bridge could be formed along the opposite side of the bridge from the tape-retaining lands and teeth-receiving groove, and the cover/cutter would be pivoted to a closed position over the bridge. This alternative design increases the radius defined between the tape-cutting means and the living hinge between the cover/cutter and the bridge.

Figure 15:
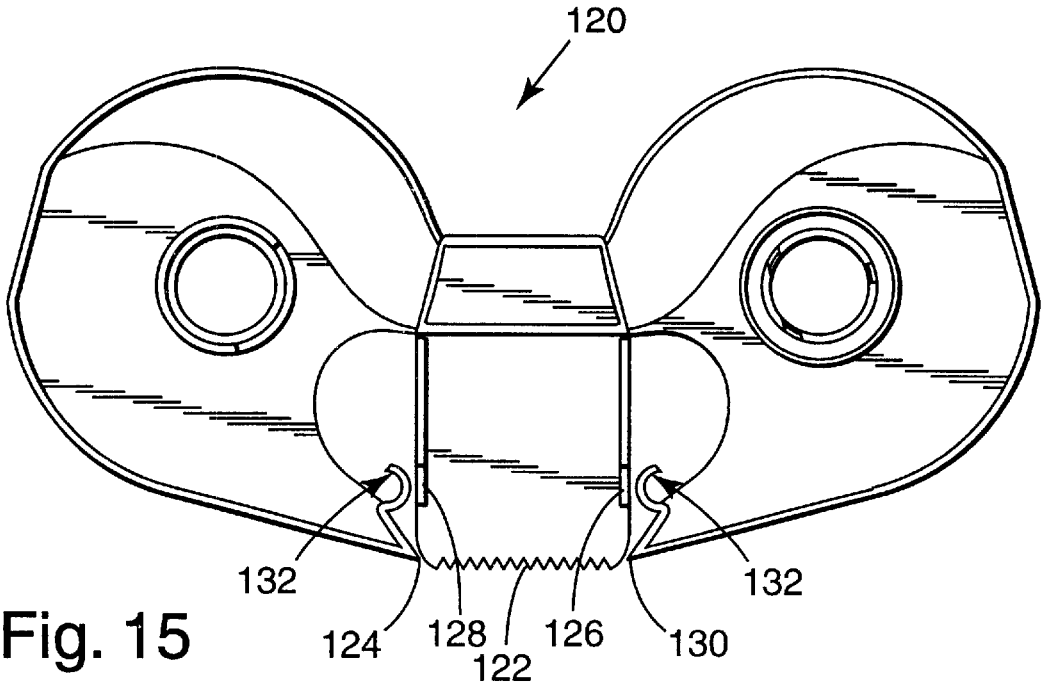
FIG. 15 is a single piece blank that is folded to form the housing of another preferred embodiment of the tape dispenser.
Figure 16:
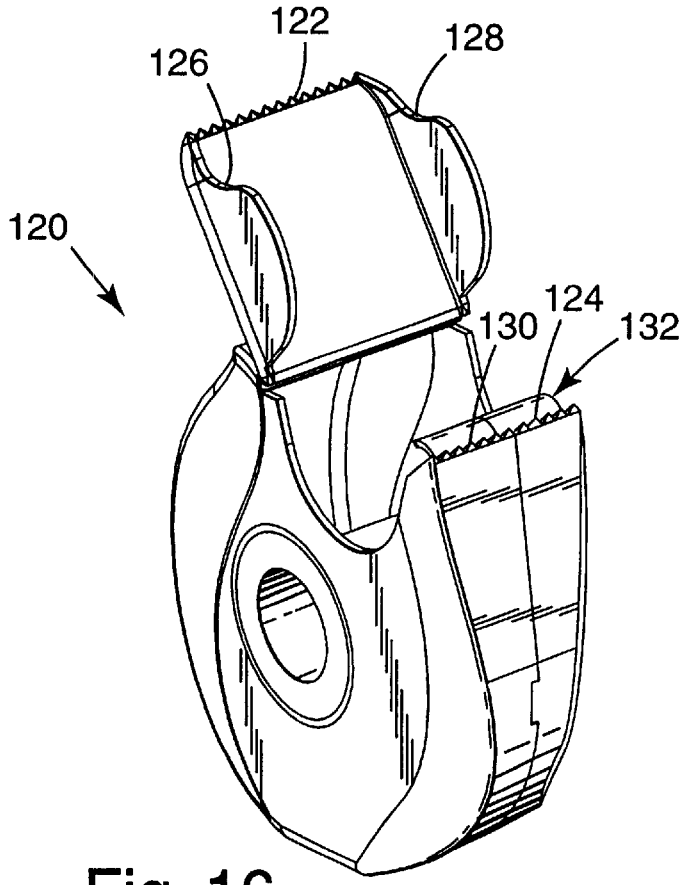
FIG. 16 is the tape dispenser formed of the blank of FIG. 15.

FIGS. 15 and 16 illustrate an alternative preferred embodiment of the tape dispenser here designated generally 120. Tape dispenser 120 includes two blades or sets of teeth 122 and 124, 130, one 122 arranged along the outer edge of the cutter/cover and one 124, 130 arranged along the edge of the opening. This allows the tape to be severed by either pulling the tape up against teeth 122 or down against teeth 124. As used in this instance "up" or "down" refer to the direction up or down the drawing sheet containing FIG. 16, which in use of the tape dispenser merely means in opposite directions since the dispenser could be held upside down or sideways. Tape dispenser 120 also includes concave edge portions 126 and 128 similar to concave edge portions 83 and 85 of tape dispenser 20. The cutting teeth 124 and 130 come together when the blank of FIG. 15 is folded into its assembled configuration shown in FIG. 16 to define one set of cutting teeth.

The tape dispenser 120 further preferably includes an arcuate land 132 for retaining the tape adjacent its cut end. The arcuate shape facilitates the tape draping or wrapping over the land 132 to help secure it on the land, while helping to keep the end of the tape free to facilitate grasping it to advance the tape to cut the next piece.

Preferred Method of Making and Assembly

A tape dispenser blank 21 is first molded, preferably by injection molding, as a single piece construction from polymeric material, such as polystyrene, polypropylene, polyethylene, polycarbonate, or acetal resin. The material may be transparent, pigmented or painted. The tape dispenser blank 21 would preferably have the configuration shown in FIG. 9.

The blank 21 includes first and second side portions 44 and 46, a cover/cutter 32, a bridge 42 connected via living hinges 50, 52 and 54 to the side portions 44, 46 and cover/cutter 32, and a hub 48 extending from at least the first side portion 44. The hub 48 preferably comprises the first and second hub portions 64 and 66 described above.

A roll 24 of tape 26 is placed on the first hub portion 64 of the hub 48, and the side portions 44 and 46 are pivoted along living hinges 50 and 52 relative to the bridge 42 and the second hub portion 66 is inserted into the opening 68 of the first hub portion 64 until the first and second hub portions 64 and 66 are interlocked. As the first and second hubs 64 and 66 are interlocked, the locking tabs 70 and annular ridge 72 "snap" together to lock the first and second side portions 44 and 46 relative to one another (FIGS. 11 and 12), and the nesting side edges 60 and 62 interlock with one another to substantially enclose the roll 24 of tape 26 within the tape dispenser 20 except for the tape-dispensing opening 30.

If the blank 21 is folded from the position shown in FIG. 9, the cover/cutter 32 will be in its closed position when the hub portions 64 and 66 interlock. Otherwise, the cover/cutter 32 is then pivoted along the living hinge 54 relative to the bridge 42 to the closed position, covering the tape-dispensing opening 30.

If a concave open area 76 is provided adjacent the free end 74 of the first hub portion 64 as discussed above (see, also, FIG. 13), the second hub portion 66 would be at least partly inserted through the concave open area 76 of the first hub portion 64 as the first and second side portions 44 and 46 are pivoted toward one another.

If a product card 92 is provided as discussed above (FIG. 14), the mounting tabs 96 on the product card would be inserted through, or placed in, the slots 100 (FIGS. 6–8) before the tape dispenser 32 is locked in its assembled configuration to hold the product card 92 and tape dispenser 32 together when the opposite side portions 44 and 46 are interlocked.

The tape dispenser 32 may be used primarily with one hand both holding the tape dispenser 32 and actuating the cover/cutter 32. A piece of tape severed by the tape-cutting means 34 is held by the outer land 89 so that is may be grasped by the other hand or by the same hand if the tape dispenser 32 is set down or otherwise held. The cover/cutter 32 may be actuated by a thumb or other digit while the body 28 is held in the palm of the hand.

Between uses, the cover/cutter 32 closes the tape-dispensing opening 30 and the tape 26 is substantially enclosed within the housing 22 (FIG. 1), thus reducing the risk of contamination of the tape 26. When the cover cutter 32 is opened (FIG. 2), the tape 26 can be reached though the arcuate access extensions 78 and 80 of the tape-dispensing opening 30 to bring a new section of tape over the tape-retaining lands 86 and 89.

The tape dispenser 32 is suitable to be used either as a disposable unit used with only one roll 24 of tape 26, or as a reusable unit that is reloaded with new rolls 24 of tape 26 after the previous roll is used. The tenacity of the locking tabs 70 or other locking means can be varied depending upon whether the tape dispenser is intended to be disposable or reused.

Advertising, instructions, bar code, etc., can also be printed on the opposite sides 44 and 46 or a label can be adhered to the opposite sides. A label, not shown, can also be provided over the cover/cutter 32 is provide an indication that the tape dispenser 32 has not been used if the label is not torn or cut.

In yet another alternative embodiment of the invention, the tape-cutting means (e.g., serrated blade or teeth) is provided on the body of the tape dispenser, and the cover is movable to open and close a tape-dispensing opening and cover or uncover the tape-cutting means.

As various changes could be made in the above constructions and methods without departing from the scope of the invention as defined in the claims, it is intended that all matter contained in the above description or shown in the accompanying drawings be interpreted as illustrative and not in a limiting sense,

What is claimed is:

1. A tape dispenser comprising a substantially palm-sized housing formed of a single piece of material, the housing substantially completely enclosing a roll of tape mounted within the housing, the housing comprising:

opposite sides having opposing flanges extending toward one another to substantially enclose the tape within the housing except for an opening;

a hub including two hub portions, one extending, from each of the sides of the housing, the hub portions interlocking to hold the housing in an assembled configuration, the hub being adapted to hold the roll of tape for rotation within the housing;

a bridge connecting the opposite sides; and a cover pivotably connected to the bridge by a living hinge, the cover being movable to an open position and a closed position, and including a cutter for severing the roll of tape into strips, wherein the cover closes the opening when in the closed position, wherein the cover comprises a first major surface, wherein the first major surface of the cover, the bridge and the living hinge substantially define a plane when the cover is in the closed position, and further wherein the first major surface of the cover, the bridge and the living hinge are substantially located in the plane when the cover is in the closed position.

2. The tape dispenser according to claim 1 wherein:

the cutter includes a cutting blade integrally formed with the cover, the cutting blade having:

cutting teeth, and reinforcement ribs integrally formed with the cutter, the reinforcement ribs being formed on a side of the teeth facing generally away from the hub; and the housing forms a channel for receiving the blade of the cutter and lands on opposite sides of the channel for releasably retaining tape in position to cut the tape with the blade.

3. The tape dispenser according to claim 1 wherein:

the two hub portions comprise first and second hub portions, the first hub portion defining an opening for receiving the second hub portion therein, the first hub portion including an annular ridge within the opening, and the second hub portion including locking tabs for engaging the annular ridge to lock the first and second hub portions together; and the first hub portion extends from a first side of the housing to a free end of the first hub portion, the free end of the first hub portion including a concave open area extending in the direction toward the first side of the housing, the concave open area facing generally in the direction of the bridge to facilitate inserting the second hub portion within the first hub portion when the opposite sides of the housing are pivoted toward each other during assembly of the tape dispenser.

4. The tape dispenser according to claim 1 wherein the opposite sides, hub and bridge constitute a body of the tape dispenser, the cover including a projection beyond the body of the tape dispenser to facilitate engaging the projection with a thumb to move the cover.

5. The tape dispenser according to claim 1 further comprising living hinges pivotably connecting the opposite sides to the bridge.

6. The combination of a roll of tape and the tape dispenser according to claims 1.

7. The tape dispenser according to claim 1 wherein at least one of the opposite sides has a concave open area extending from the opening toward the hub to provide manual access to the tape when the cover is in the open position, and the cover includes a convex flange substantially matching the concave open area to cover the concave open area when the cover is in the closed position.

8. The tape dispenser according to claim 7 wherein the opposing flanges each have a nesting side edge for interlocking with the nesting side edge of the other flange, the tape dispenser further comprising a product card having an opening for receiving the housing and tabs for mounting the product card on the housing, the nesting side edges forming slots for receiving the tabs on the product card to hold the product card and housing together.

9. The tape dispenser according to claim 8 wherein:

the two hub portions comprise first and second hub portions, the first hub portion defining an opening for receiving the second hub portion therein, the first hub portion including an annular ridge within the opening, and the second hub portion including locking tabs for engaging the annular ridge to lock the first and second hub portions together; and the first hub portion extends from a first side of the housing to a free end of the first hub portion, the free end of the first hub portion including a concave open area extending in the direction toward the first side of the housing, the concave open area facing generally in the direction of the bridge to facilitate inserting the second hub portion within the first hub portion when the opposite sides of the housing are pivoted toward each other during assembly of the tape dispenser.

10. The tape dispenser according to claim 9 wherein the opposite sides, hub and bridge constitute a body of the tape dispenser, the cover including a projection beyond the body of the tape dispenser to facilitate engaging the projection with a thumb to move the cover.

11. The tape dispenser according to claim 10 further comprising living hinges pivotably connecting the opposite sides to the bridge.

12. The tape dispenser according to claim 11 wherein:

the cutter includes a cutting blade integrally formed with the cover, the cutting blade having:

cutting teeth, and reinforcement ribs integrally formed with the cutter, the reinforcement ribs being formed on a side of the teeth in the direction facing generally away from the hub; and the housing forms a channel for receiving the blade of the cutter and lands on opposite sides of the channel for releasably retaining the tape in position to cut the tape with the blade.

13. The combination of a roll of tape and the tape dispenser according to claim 12.

14. The tape dispenser according to claim 1 wherein the opposing flanges each have a nesting side edge for interlocking with the nesting side edge of the other flange, the tape dispenser further comprising a product card having an opening for receiving the housing and tabs for mounting the product card on the housing, the nesting side edges forming slots for receiving the tabs on the product card to hold the product card and housing together.

15. The tape dispenser according to claim 14 wherein:

the two hub portions comprise first and second hub portions, the first hub portion defining an opening for receiving the second hub portion therein, the first hub portion including an annular ridge within the opening, and the second hub portion including locking tabs for engaging the annular ridge to lock the first and second hub portions together; and the first hub portion extends from a first side of the housing to a free end of the first hub portion, the free end of the first hub portion including a concave open area extending in the direction toward the first side of the housing, the concave open area facing generally in the direction of the bridge to facilitate inserting the second hub portion within the first hub portion when the opposite sides of the housing are pivoted toward each other during assembly of the tape dispenser.

16. The tape dispenser according to claim 15 wherein the opposite sides, hub and bridge constitute a body of the tape dispenser, the cover including a projection beyond the body of the tape dispenser to facilitate engaging the projection with a thumb to move the cover.

17. The tape dispenser according to claim 16 further comprising living hinges pivotably connecting the opposite sides to the bridge.

18. The tape dispenser according to claim 17 wherein:

the cutter includes a cutting blade integrally formed with the cover, the cutting blade having:

cutting teeth, and reinforcement ribs integrally formed with the cutter, the reinforcement ribs being formed on a side of the teeth in the direction facing generally away from the hub; and the housing forms a channel for receiving the blade of the cutter and lands on opposite sides of the channel for releasably retaining the tape in position to cut the tape with the blade.

19. A tape dispenser comprising a housing formed of a single piece of material, the housing comprising:

opposite sides having opposing flanges extending toward one another to substantially enclose a roll of tape within the housing except for an opening;

a hub extending from at least one of the opposite sides and adapted to hold the roll of tape for rotation within the housing;

a bridge connecting the opposite sides; and a cover pivotably connected to the bridge by a living hinge, the cover being movable to an open position and a closed position, and including a cutter for severing the roll of tape into strips, wherein the cover closes the opening when in the closed position, wherein the cover comprises a first major surface, wherein the first major surface of the cover, the bridge and the living hinge substantially define a plane when the cover is in the closed position, and further wherein the first major surface of the cover, the bridge and the living hinge are substantially located in the plane when the cover is in the closed position.

20. The tape dispenser according to claim 19 wherein:

the cutter includes a cutting blade integrally formed with the cover, the cutting blade having:

cutting teeth, and reinforcement ribs integrally formed with the cutter, the reinforcement ribs being formed on a side of the teeth in a direction facing generally away from the hub.

21. The tape dispenser according to claim 19 wherein the housing forms a channel for receiving the blade of the cutter and lands on opposite sides of the channel for releasably retaining the tape in position to cut the tape with the blade.

* * * * *

UNITED STATES PATENT AND TRADEMARK OFFICE

CERTIFICATE OF CORRECTION

PATENT NO. : 6,386,416 B1
DATED : May 14, 2002
INVENTOR(S) : Dunshee, Wayne K.

It is certified that error appears in the above-identified patent and that said Letters Patent is hereby corrected as shown below:

Title page,
Item [56], U.S. PATENT DOCUMENTS, insert -- US Patent 2,802,257 --.
Item [57], ABSTRACT, the third instance of "be" should read -- by --.

Column 1,
Line 39, "ajournal" should read -- a journal --.
Line 43, "Pat. No. 64,733" should read -- Pat. No. 164,733 --.
Line 57, "server" should read -- sever --.
Line 65, "assembly" should read -- assemble --.

Column 2,
Line 41, "form" should read -- from --.

Column 11,
Line 3, "ctc." should read -- etc. --.

Signed and Sealed this

Eighth Day of April, 2003

JAMES E. ROGAN
*Director of the United States Patent and Trademark Office*